US010684090B2

(12) United States Patent
Agnelli, Jr.

(10) Patent No.: US 10,684,090 B2
(45) Date of Patent: Jun. 16, 2020

(54) PISTOL FRAME DISASSEMBLY BED

(71) Applicant: Vincent R Agnelli, Jr., Catlett, VA (US)

(72) Inventor: Vincent R Agnelli, Jr., Catlett, VA (US)

( * ) Notice: Subject to any disclaimer, the term of this patent is extended or adjusted under 35 U.S.C. 154(b) by 0 days.

(21) Appl. No.: 16/387,993

(22) Filed: Apr. 18, 2019

(65) Prior Publication Data

US 2019/0242669 A1 Aug. 8, 2019

Related U.S. Application Data

(63) Continuation-in-part of application No. 15/418,780, filed on Jan. 30, 2017, now Pat. No. 10,345,066.

(51) Int. Cl.
*F41A 23/18* (2006.01)
*F41A 11/00* (2006.01)
*F41A 29/00* (2006.01)

(52) U.S. Cl.
CPC ..... *F41A 23/18* (2013.01); *F41A 11/00* (2013.01)

(58) Field of Classification Search
CPC ..... F41A 11/00; F41A 23/18; F41A 29/00; F41A 35/00; F41C 27/00; F41C 3/06
USPC ..... 42/108
See application file for complete search history.

(56) References Cited

U.S. PATENT DOCUMENTS 2,877,689 A * 3/1959 Pribis ..... F41A 23/18 89/37.04
4,438,913 A 3/1984 Hylla
4,466,537 A * 8/1984 McMahan ..... F41C 33/0218 206/3
4,548,392 A 10/1985 Rickling
5,058,302 A * 10/1991 Minneman ..... F41A 23/18 206/315.11
5,621,996 A * 4/1997 Mowl, Jr. ..... F41A 23/18 211/64
5,662,219 A * 9/1997 Tschudy ..... A45C 13/02 150/113
5,720,193 A * 2/1998 Dick ..... E05B 37/00 211/64
6,105,951 A * 8/2000 Shibata ..... B23Q 3/067 269/100
6,400,269 B1 * 6/2002 Savastano ..... F41C 33/06 340/506
6,725,534 B1 4/2004 Schwartzbauer
6,761,101 B1 * 7/2004 Luth ..... B25B 1/2457 269/54
6,880,239 B1 4/2005 Jennings et al.
7,690,606 B1 * 4/2010 Batdorf ..... B25B 1/22 248/181.1
8,201,314 B2 6/2012 Miller et al.
8,209,896 B1 * 7/2012 Cashwell ..... F41A 23/18 206/317
8,281,477 B2 10/2012 Munster et al.
8,727,294 B1 * 5/2014 Harms ..... F41A 23/18 206/317

(Continued)

*Primary Examiner* — Derrick R Morgan
(74) *Attorney, Agent, or Firm* — Jonathan Brown

(57) ABSTRACT

A firearm disassembly bed system comprised of a top unit a base unit, and apparatus for attaching the top unit and base unit to each other in a reversible manner. The firearm disassembly bed system is further comprised of a Y-block and apparatus for securely fitting the Y-block to the top unit in a manner to provide for safe maintenance of a firearm.

19 Claims, 17 Drawing Sheets

(56) References Cited

U.S. PATENT DOCUMENTS 8,899,416 B2 * 12/2014 McDonnough ..... A45C 13/02 206/373
9,009,986 B1 * 4/2015 Chang ..... F41A 3/66 33/640
9,194,653 B1 * 11/2015 Jenkinson ..... F41C 27/00
9,500,439 B1 * 11/2016 Dietrich ..... F41A 3/72
10,415,929 B2 * 9/2019 Hurley ..... F41A 3/66
2003/0121741 A1 * 7/2003 Japchen ..... A45C 13/18 190/101
2006/0053674 A1 * 3/2006 Shober ..... F41A 11/00 42/108
2007/0068835 A1 * 3/2007 Buie, II ..... F41A 23/18 206/373
2007/0294929 A1 * 12/2007 Potterfield ..... F41A 35/00 42/94
2009/0193703 A1 * 8/2009 Riley ..... F41A 23/18 42/94
2010/0095576 A1 * 4/2010 Johns ..... F41A 21/00 42/108
2010/0126055 A1 * 5/2010 Potterfield ..... F41A 23/16 42/94
2011/0067226 A1 * 3/2011 Westbrook ..... B23B 47/28 29/559
2011/0113669 A1 * 5/2011 Oselinsky ..... F41A 29/02 42/90
2012/0005937 A1 * 1/2012 Milino ..... F41A 23/18 42/108
2012/0291330 A1 * 11/2012 Johnson ..... F41A 11/00 42/108
2013/0074393 A1 * 3/2013 Curry ..... F41A 11/00 42/108
2013/0318850 A1 * 12/2013 Holmes ..... F41C 27/00 42/90
2015/0033609 A1 * 2/2015 Herdman ..... F41A 23/18 42/70.07
2015/0121742 A1 * 5/2015 Wilkinson ..... F41A 11/00 42/108
2015/0159972 A1 * 6/2015 Folk ..... F41A 35/00 29/426.2
2017/0087873 A1 * 3/2017 Freybler ..... F41A 35/00
2017/0095907 A1 * 4/2017 McClain ..... F41A 23/18
2017/0138685 A1 * 5/2017 Beasley ..... F41A 9/71
2017/0314882 A1 * 11/2017 Strombeck ..... F41A 11/00
2017/0350665 A1 * 12/2017 Borges ..... F41A 11/02
2018/0087863 A1 * 3/2018 Sexton ..... F41A 29/00
2019/0063863 A1 * 2/2019 Morris ..... F41A 23/18
2019/0072357 A1 * 3/2019 Couie ..... F41A 23/18
2020/0003518 A1 * 1/2020 Jacobson ..... F41A 29/00

* cited by examiner

PISTOL FRAME DISASSEMBLY BED

CROSS REFERENCE TO RELATED APPLICATION(S)

This application is a Continuation in Part of, and claims the benefit of, application of U.S. patent application Ser. No. 15/418,780, filed on Jan. 30, 2017.

Application Ser. No. 15/418,780 is a Divisional application of, and claims the benefit of, U.S. Utility application Ser. No. 15/062,052 entitled "PISTOL FRAME DISASSEMBLY BED," filed on Mar. 5, 2016. The subject matter of these applications is hereby incorporated by reference in their entirety.

TECHNICAL FIELD OF THE INVENTION

The present invention relates to the general art of pistol maintenance and repair and more specifically to devices and methods for disassembly and reassembly of pistol frames.

BACKGROUND OF THE INVENTION

Manufacturers of weapons such as semi-automatic pistols, as well as other firearms, recommend that owners have them on a regularly scheduled maintenance program. Regular maintenance allows each owner and/or user to clean their pistol regularly, to perform any routine maintenance a pistol might need, to periodically inspect the pistol to remove accumulated dirt, and other foreign material and perform upgrades.

It is further and more specifically recommended that each owner/user disassemble, clean, and lubricate each pistol after each use or at least on a regularly scheduled basis. In this process, the pistol frame and trigger system are disassembled so that the entire mechanism can be cleaned and/or lubricated.

However, disassembly is a chore many gun owners avoid or put off as long as possible because disassembly is often a difficult and frustrating task. To properly disassemble a firearm such as a pistol, stability of the pistol itself is required, or at the least, very helpful. Stability is difficult to achieve because pistols are not of a symmetrical shape such as a square or circle, making them awkward to hold and try to clean. A pistol has a number of small, parts and as these are removed, they must be carefully accounted for. If a pistol is being held or supported in an unstable way, the parts can slip and roll or bounce away. Depending on the size, shape and color of a part that slips away, it can be difficult or even impossible to locate. Lost parts will make a firearm unsafe or completely inoperable.

Further, tools are usually required to disassemble a pistol, such as punching tools or hammers. If a pistol is unsupported or supported inadequately, the tool may slip and scratch or otherwise damage the pistol. This kind of damage, depending on where it is on the pistol and degree, can damage the aesthetics of the firearm or even damage its functioning. If the damage is beyond aesthetic, it can present a safety issue.

To deal with this issue, a pistol can be placed in a clamp type device, as known in the art, but the pistol might be damaged at the point at which clamp pressure is being applied. Also this does not address the problem of the possibility of parts becoming separated and flying or bouncing somewhere else. The most common procedure is probably to lay a pistol out on a flat surface for disassembly. This procedure does not address either problem, as the pistol is unstable whenever worked upon, so that either parts can be lost or the pistol can be damaged. This can be particularly true of weapons such as the Ruger LC series, which utilize a number of removable small pins to hold the weapon together.

The Ruger, and weapons design similar to it, have special requirements regarding maintenance procedures. Ruger has a gate, on one side of the weapon, to a pin to remove the slide, but no indication or marker of where the pin is on the other side. The trigger can be removed, but requires the removal of additional pins in advance, to help the user access further components.

Another issue with weapon disassembly is the potential for dangers. These can include the magazine being accidentally left in the weapon with shells still in it. This, in turn, might result in accidental discharge. Another danger is that one may accidentally jostle the trigger, or pull the trigger. Whether the magazine is removed or not, if there is a shell in the chamber, this could also result in a discharge. Dangers such as these during disassembly and maintenance can have tragic consequences.

Accordingly, there is a need in the art for a device and method that offers a steady platform for disassembling and reassembling pistols, in a safer and more controlled manner for repairs, maintenance and upgrades, that makes the pistol immobile, stable, easy to work on, and helps insure that the smaller parts of the pistol do not get lost.

SUMMARY

A Pistol Frame Disassembly Bed (PFDB) is disclosed. The PFDB is generally in the overall configuration of a box, and is comprised, generally, of a pistol bed having a bed depression for holding a pistol frame, a trigger mechanism housing aperture, and a drawer.

The top surface of the PFDB incorporates the pistol bed. The pistol bed is a three-dimensional depression, depressed in relation to the top of the PFDB. In this embodiment, a pistol to be disassembled is comprised of a slide assembly portion and a frame (receiver) portion. The pistol bed is in the shape of a side of a pistol frame (receiver) to accommodate it. The pistol bed can be sized and shaped to neatly and snugly accommodate a specific type of pistol.

The PFDB can be manufactured in any suitable size and configuration, depending upon such factors as what specific type of firearm the PFDB is to accommodate and materials of construction.

At a portion of the top of the PFDB, there can be a three-dimensional trigger mechanism housing aperture, designed specifically to hold a trigger mechanism housing.

A drawer is located at the bottom of the PFDB. The drawer is slightly smaller than the length and width of the housing of the PFDB. To open the drawer, a user simply holds the handle and pulls the drawer from the PFDB. The drawer in this embodiment is designed to open from the front; however, it can be designed for convenience sake to open from any of the four sides, depending upon the pistol model. The drawer may optionally contain a divider from front to back, or side-to-side, to help keep different parts separated, and for structural support if necessary.

The pistol bed is typically comprised of several different general areas corresponding to portions of the frame. The pistol bed is generally comprised of a forward frame area, a rear frame area, and a pistol grip receiving area.

The depth of the pistol bed will typically vary slightly among the respective areas and within each area to accommodate the shape of the frame. The pistol bed is further comprised of a depressed trigger guard area, which typically has a depth somewhat less than that of the rest of the pistol bed.

The pistol bed and bed wall can be covered in a soft material to protect the pistol frame, or a protective coating can be placed in strategic areas of the pistol bed to prevent scratching or other damage during the disassembly and reassembly process. The user will have complete control over the work as it sits in the PFDB.

The PFDB has pass-through apertures located at suitable locations as needed on the pistol bed that go through to the drawer below.

A trigger mechanism housing aperture is present in roughly the shape of a triangle with one curved side in a typical embodiment. The trigger mechanism housing aperture like the other parts herein, can be of any appropriate dimension for the pistol(s) for, which the PFDB is being used.

In another set of embodiments of the invention, the key notch is generally comprised of a set of partial key notches attached, respectively, to a lower key placement rod and upper key placement hooks.

The placement rod is rounded, attached to the end of its respective partial key notch, and is generally perpendicular to the partial key notch. The upper key placement hooks have a protruding triangular, partially triangular, or hook-shaped horizontally extending protrusion in orientation to the Y-block. In one specific embodiment, the upper key placement hooks are each in the shape of a pair of combined triangles, one of them protruding from each partial key notch. An alternative top unit with a pair of, hook receptacle slots and a placement rod receptacle slot is also provided. The placement rod receptacle slot is generally cross-shaped in this embodiment to accommodate the partial key notch and placement rod, which are perpendicular to each other.

By moving the Y-Block in a downward and forward manner in the direction of the lower key notches, the placement hooks slide downward and into the placement hook receptacle slots. Similarly, the lower key placement rod is placed into the placement rod receptacle slot with the same downward and forward motion to the Y-block.

While the Y-Block is being slid into its operational position, the upper key notches allow the upper key placement hooks to slide under the surface of the top unit. In this manner, the key placement hooks and placement rod work together to provide extra securement of the Y-block to the top unit when needed. This arrangement helps prevent the Y-Block from coming loose or disengaging when in use.

In other embodiments, the key notch set, and by extension the Y-block, can be secured by other suitable apparatus, such as by providing other means onto the partial keys. In one embodiment, placement pegs are provided protruding from the upper partial key notches are provided. The placement pegs can be slid directly and securely into fitted slots as the Y-block is fitted to the top unit.

The materials of construction of the PFDB, or its constituent parts, can be any as known and suitable in the art, including but not limited to wood, metal, plastic or resin, or other suitable materials. The size and materials of construction of the PFDB and its individual parts may vary, depending on several factors, such as the pistol(s) the unit is designed for, the materials of construction and manufacturing process used. To achieve the desired strength, durability and efficiency of the PFDB, the planning, design and manufacturing stage will determine the exact size of the PFDB depending upon the material used.

Further, the PFDB can be produced in a number of different, or even slightly different, models. The basic pistol bed and configuration of bed wall of the PFDB can be modified to accommodate different designs, sizes and shapes of pistols, of various manufacturers.

In a further embodiment, a top unit capable of accommodating a Y-Block is provided. This top unit has pass-through apertures at suitable locations and a supportive pad to cushion a firearm. There are Y-Block receptacle slots for attaching a Y-Block and a set of frame guides to help seat a firearm in the top unit.

The Y-Block is comprised of at least one access aperture to provide access to a specific portion of a secured firearm, and a set of supports that connect the Y-Block to the top unit configured to accept the Y-Block. The support means in this embodiment are comprised of at least one lower key and at least one upper key.

There are also accompanying apparatus for securing the keys to the top unit. In one embodiment, this is done by providing a set of notches at the bottom of the respective upper and lower keys and a corresponding set of Y-Block receptacle slots.

The Y-Block provides extra securement of a firearm or receiver that allows for the use of isometric pressure to move the slide an equal but opposite distance from the frame in the disassembly process. The "Y-Block" can then be used to reassemble a slide to a frame and line up specific components.

DETAILED DESCRIPTION OF PREFERRED EMBODIMENTS

Other objects, features and advantages of the invention will become apparent from a consideration of the following detailed description and the accompanying drawings. The following descriptions are made referring to the figures, wherein like reference numbers refer to like features throughout this description. Not all numbers appearing in one figure are necessarily present in another.

Turning generally to FIGS. 1-7, the parent subject matter from which this application depends, is shown and described.

Turning to FIGS. 8-12A, the immediate subject matter of this application is shown and described in further detail.

Figure 1:
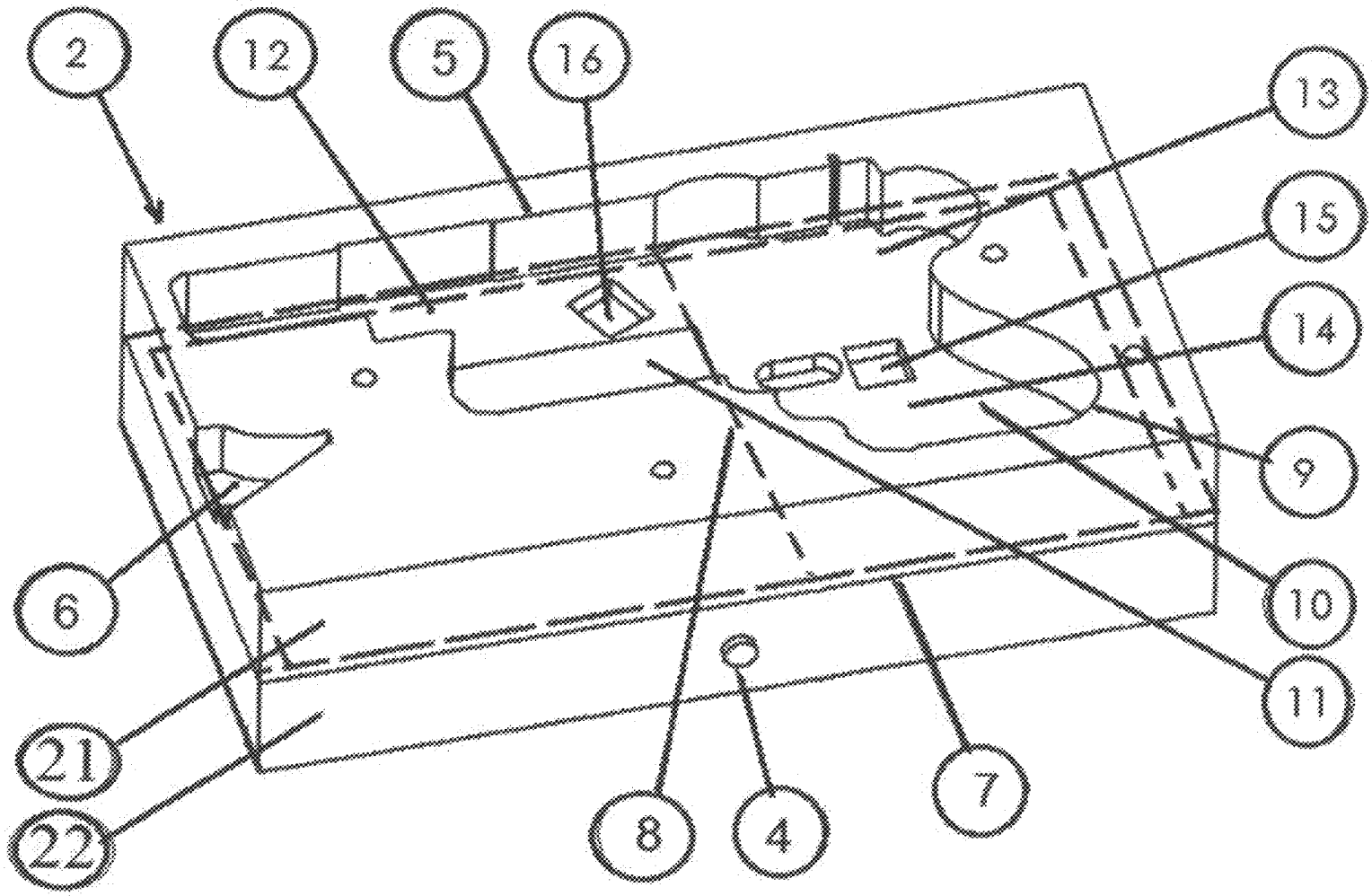
FIG. 1 is a schematic perspective view of a preferred embodiment of the invention.
Figure 2:
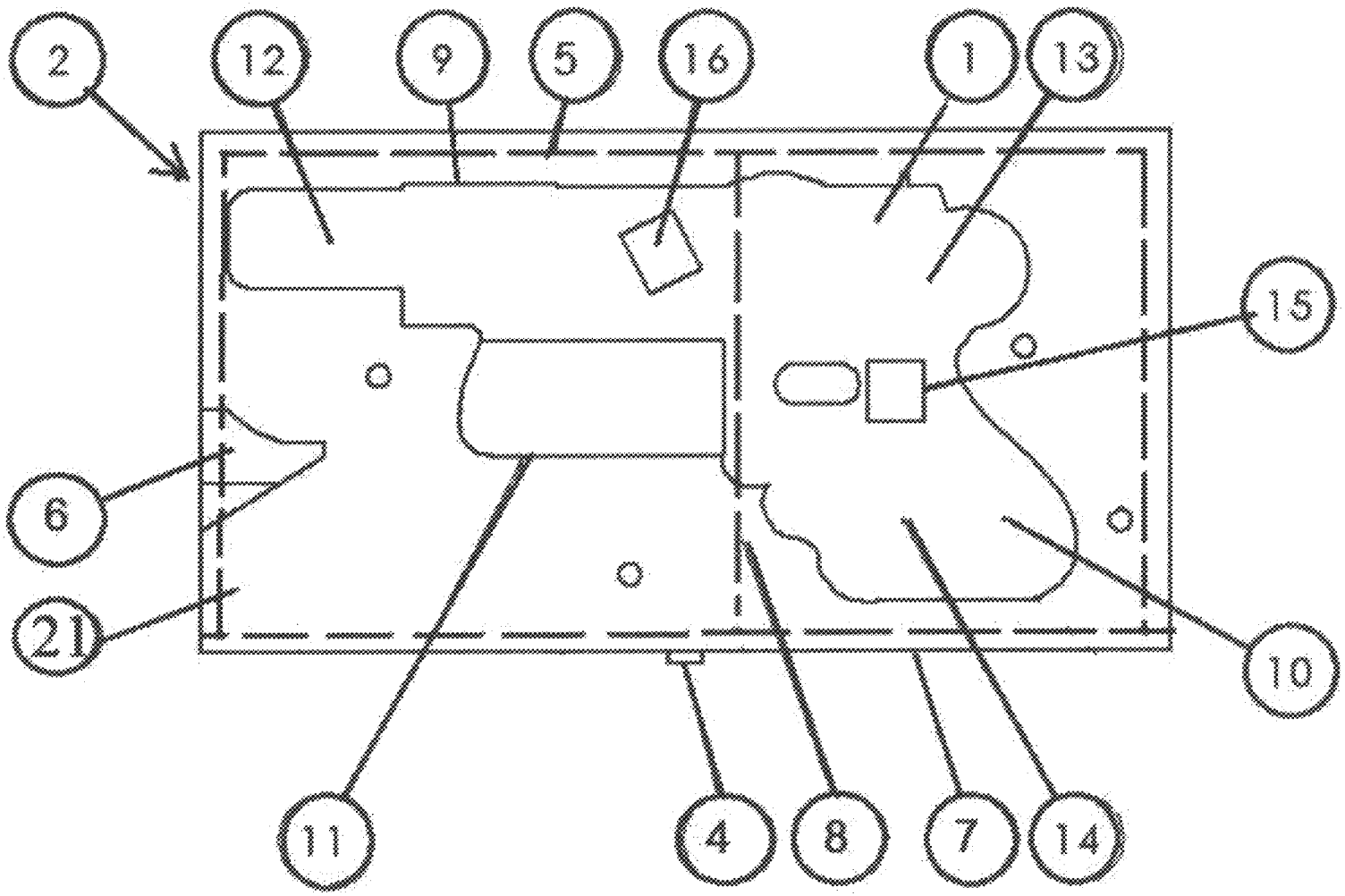
FIG. 2 is a schematic top plan view of the embodiment of FIG. 1.

Turning first to FIGS. 1-2, a Pistol Frame Disassembly Bed (hereinafter "PFDB") 2 is shown. The PFDB 2 is generally in the overall configuration of a box, and is comprised, generally, of a pistol bed 5 having a bed depression 10 for holding a pistol frame, a trigger mechanism housing aperture 6, and a drawer 7.

The PFDB 2 can be a single-unit construction, or, as in this embodiment, comprised of two units, a top unit 21 containing the pistol bed 5 and trigger mechanism housing aperture 6, and base unit containing the drawer 7 and related structures, both of which are joined together through means known in the art, such as an adhesive or other securing apparatus.

The top surface of the PFDB 2 incorporates the pistol bed 5. The pistol bed 5 is a three-dimensional depression, depressed in relation to the top of the PFDB 2. In this embodiment, a pistol to be disassembled is comprised of a slide assembly portion (Not shown) and a frame (receiver) portion 100, in FIG. 3. The pistol bed 5 is in the shape of a side of a pistol frame (receiver) 100, in FIG. 3, to accommodate it.

Figure 3:
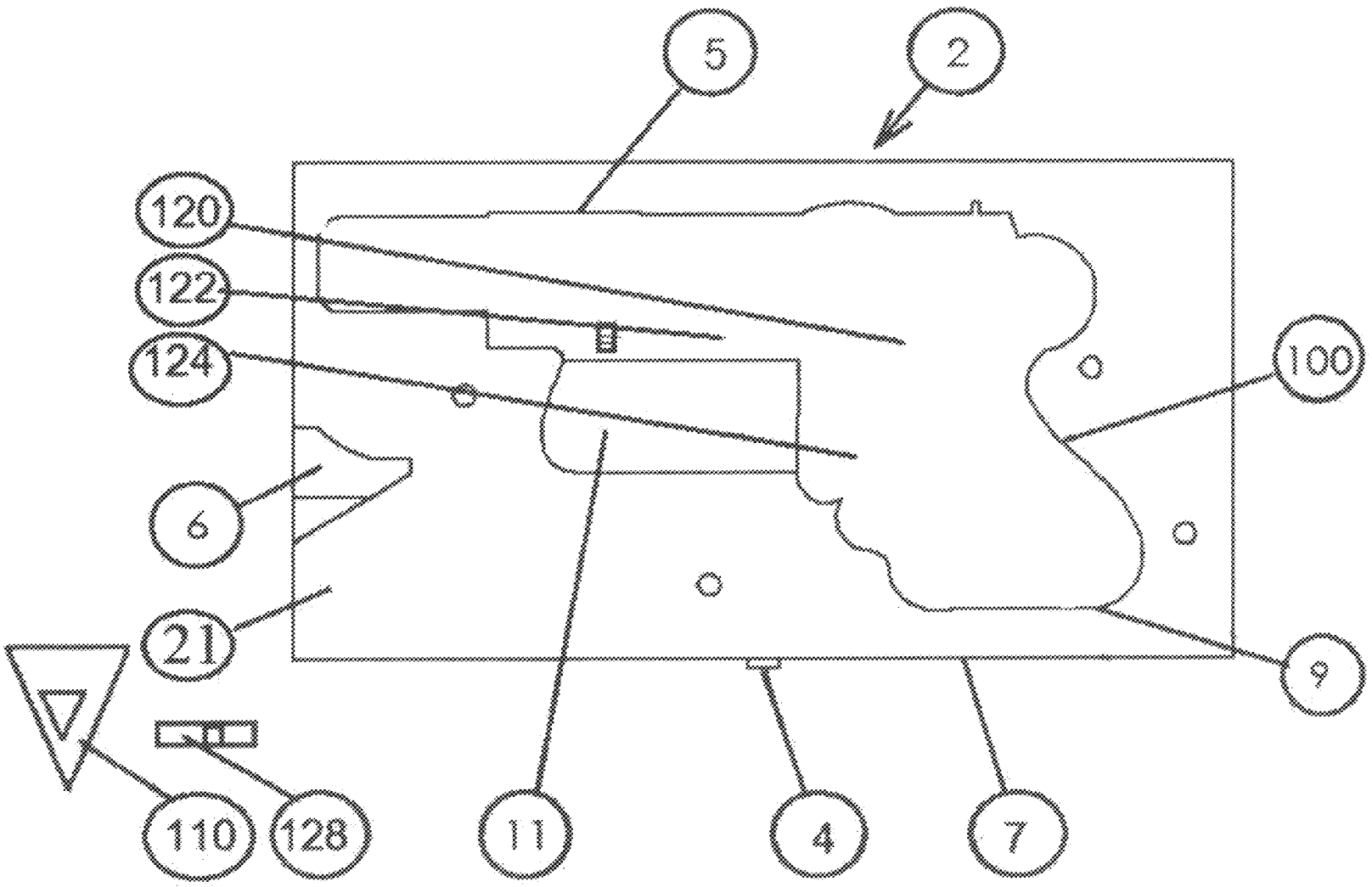
FIG. 3 is a schematic top plan view of the embodiment of FIG. 1 showing the invention in use.

When manufactured, the pistol bed 5 will be sized and shaped to neatly and snugly accommodate a specific type of pistol. In this embodiment, for example, the pistol bed 5 and pistol bed wall 9, in FIGS. 1-2, within are shaped and of a depth to specifically accommodate a Glock™ generation 1-4 pistol model. The pistol bed wall 9 is about one-half inch high to accommodate part of the frame 100, which is shown in FIG. 3.

Overall, the PFDB 2 can be manufactured in any suitable size and configuration, depending upon such factors as what specific type of firearm the PFDB 2 is to accommodate and materials of construction. In this embodiment, to accommodate a Glock™ generation 1-4 pistol, the approximate dimensions of the PFDB 2 are 10"L×6"W×3"H.

Figure 5:
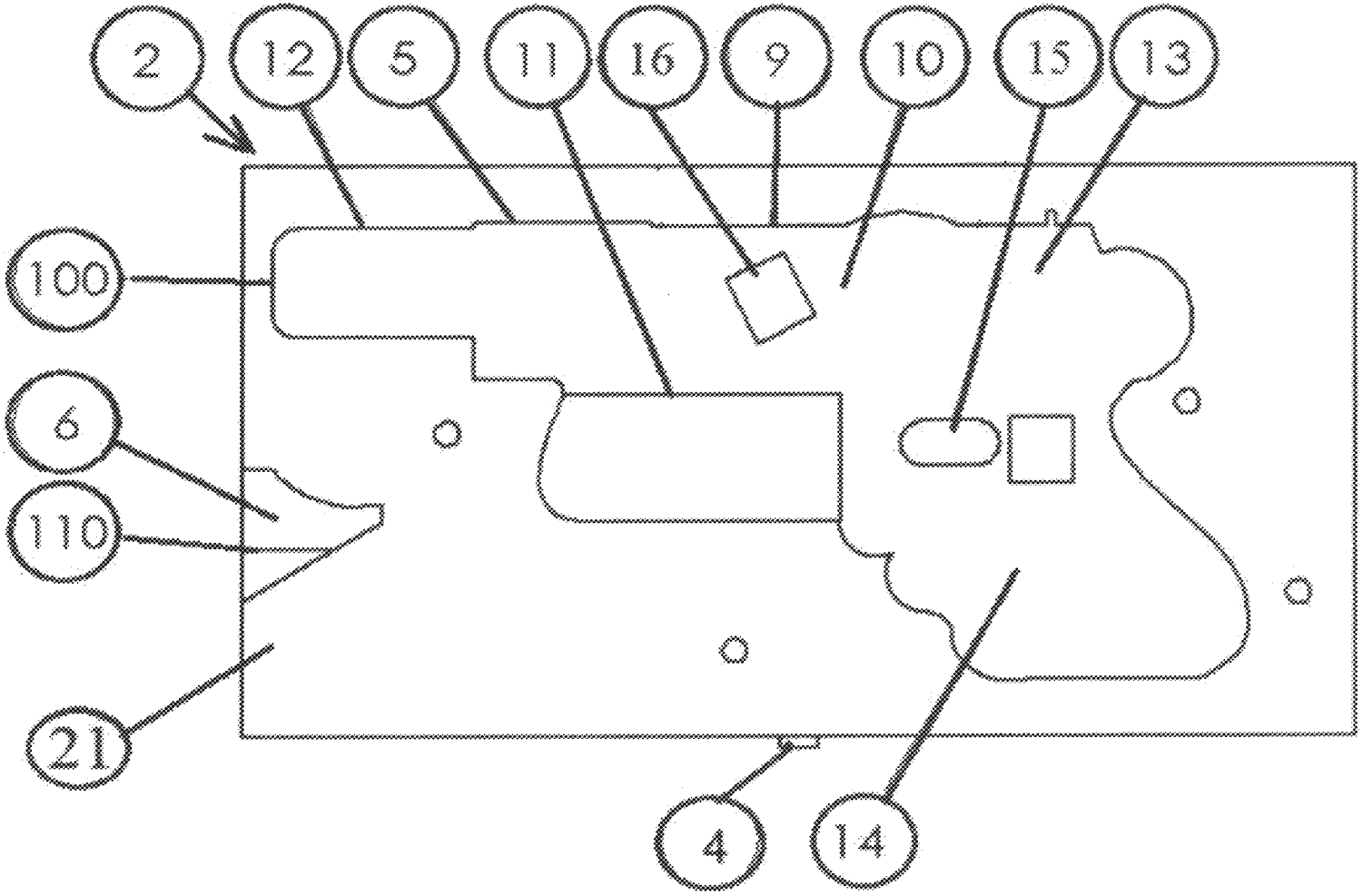
FIG. 5 is a schematic top plan view of the embodiment of FIG. 1 showing an aspect of the invention in use.

At a portion of the top of the PFDB 2, typically somewhat away from the pistol bed 5, if required by make and model, there can be a three-dimensional trigger mechanism housing aperture 6, in FIGS. 1-2, designed specifically to hold a trigger mechanism housing 110. In this embodiment, the trigger mechanism housing aperture 6 is roughly in the shape of a triangle with one curved side. Turning briefly to FIG. 5, the trigger mechanism housing aperture 6 is designed and shaped specifically to hold a Glock™ generation 1-4 pistol trigger mechanism housing with ejector 110, in FIG. 5, and in this embodiment, is located near the corner of the PFDB 2 furthest from the pistol bed 5 for convenient access.

Returning to FIGS. 1-2, a drawer 7 is located at the bottom of the PFDB 2. The drawer is slightly smaller than the length and width of the housing of the PFDB 2 and in this embodiment, it is about one inch in height. To open the drawer 7, a user simply holds the handle 4 (which can also be a recessed design drawer pull or other suitable apparatus to help open a drawer) and pulls the drawer from the PFDB 2. The drawer in this embodiment is designed to open from the front; however, it can be designed for convenience sake to open from any of the four sides, depending upon the pistol model. The drawer may optionally contain a divider 8 from front to back, or side-to-side, to help keep different parts separated, and for structural support if necessary.

Returning to discussion of the pistol bed 5, the pistol bed is typically comprised of several different general areas corresponding to portions of the frame 100, FIG. 3. In this embodiment, in FIGS. 1-2, the pistol bed 5 is generally comprised of a Forward frame area, 12, a Rear frame area 13, and a pistol grip receiving area 14.

Figure 4:
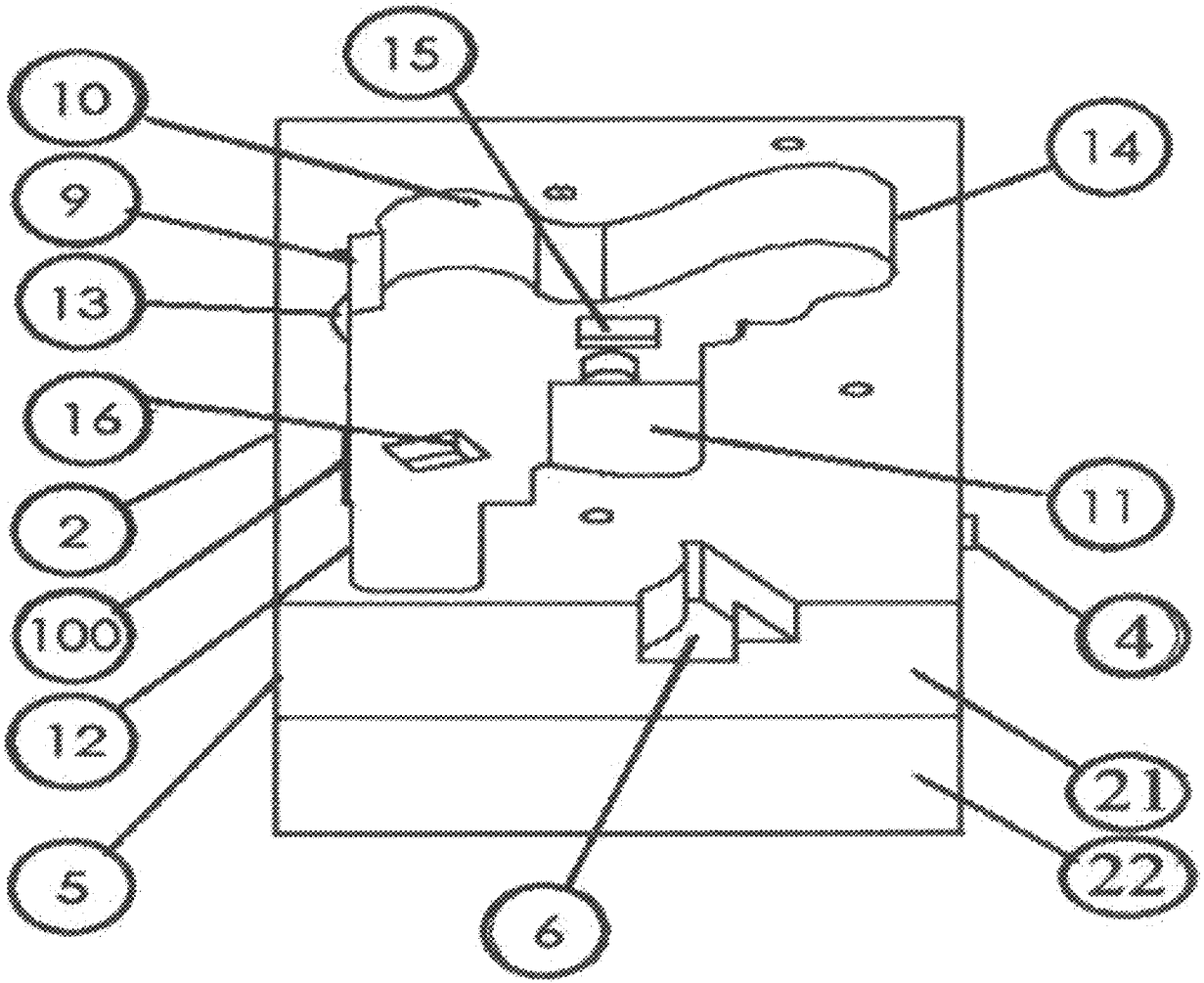
FIG. 4 is a schematic forward perspective view of the embodiment of FIG. 1.

The depth of the pistol bed 5 will typically vary slightly among the respective areas 12, 13, 14, in FIGS. 1-2, and within each area to accommodate the shape of the frame. The pistol bed 5 is further comprised of a depressed trigger guard area 11, which typically has a depth somewhat less than that of the rest of the pistol bed 5. In this embodiment the trigger guard area 11, in FIGS. 1-2, is about one-quarter inch deep to accommodate the trigger area of a Glock™ generation 1-4 pistol. Turning briefly to FIG. 4, the pistol bed 5 and bed wall 9 can be covered in a soft material to protect the pistol frame, or a protective coating can be placed in strategic areas of the pistol bed 5 to prevent scratching or other damage during the disassembly and reassembly process. The user will have complete control over the work as it sits in the PFDB 2.

The PFDB 2 has pass-through apertures, in this embodiment a pair of pass-through apertures, 15, 16, in FIG. 1-2 located at suitable locations on the pistol bed 5 that go through to the drawer 7 below.

Turning to FIG. 3, an example of use of the PFDB 2 will be discussed. A firearm, in this embodiment a Glock™ generation 1-4 pistol, is provided. As stated previously, though, the pistol to be worked on can be of any suitable type for disassembly and reassembly.

As a critical first step, the user of a PFDB 2 should always insure that the firearm is not loaded.

In a second step, the user separates the slide assembly (not shown) from the frame 100, in FIG. 3, as well as from any magazine. Any added modifications or additions to the basic frame 100 of the pistol, such as a frame mounted light or laser unit, must be removed so that the pistol frame 100 will fit into the pistol bed 5.

In a third step the user places the frame 100, FIG. 3, on its side and into the appropriate side of the pistol bed 5 into which it will fit.

In a fourth step, with the Generation 1 through Generation 4 Glock™ pistol model of this embodiment, in FIG. 3, the user removes the Locking Block Pin 120 and or Trigger Pin 124, as required by specific models, such as Glock™ models G42 and G43. The user typically will use a punch-style tool and usually a small hammer (not shown).

The pass-through apertures 15, 16 (not visible here. See FIGS. 1-2), are positioned in the pistol bed 5 such that they are directly under the pins 120, 122 124, FIG. 3, when the frame 100 is placed in the pistol bed 5. The user strikes or punches the pins 120, 122, 124, in the frame 100. The pins 120, 122, 124, when punched out, can fall safely and without damage through the pass-through apertures 15, 16 (See FIGS. 1-2) and into the removable drawer 7. The drawer 7 can not only catch and hold the pins but can also be used to store small tools, and parts (not shown) used in the maintenance process.

In a fifth step, the user can use a punch, punch-style tool, or other appropriate tool(s) to safely remove the connector. This is often done with the use of a screwdriver or similar tool which could potentially damage the connector.

Moving briefly to FIG. 5, in a sixth step, the user removes the trigger mechanism housing 110 from the frame 100, and places the trigger mechanism housing 110 in the trigger mechanism housing aperture 6, facing downward. The user can then push the connector 128 of the weapon (depicted in FIG. 3) out through the other side of the trigger mechanism housing 110. The connector falls from the trigger mechanism housing aperture 6 and into the provided recessed area.

The trigger mechanism housing aperture 6, FIG. 1-2, is roughly in the shape of a triangle with one curved side, and herein, is designed in size and shape to hold the Trigger Mechanism Housing of a Glock™ generation 1-4 pistol. The trigger mechanism housing aperture 6, FIG. 1-2, like the other parts herein, can be of any appropriate dimension for the pistol(s) for, which the PFDB 2 is being used. In this embodiment, the trigger mechanism housing aperture 6 is two inches or slightly less in length and width to accommodate a recess for capture of the connector, and it has a two-level depth of one-half inch and three-quarters of an inch, respectively.

In a seventh step, when a user wishes to reassemble the pieces, of the receiver 100, FIG. 3, the user first reassembles and installs the trigger mechanism housing 110. The user should secure the pistol frame 100 back into the pistol bed 5 for increased stability. Then the user can install (on applicable models) the trigger pin 124, the trigger housing pin 122, and the locking block pin 120. The user can hold the pistol frame 100 in place in the pistol bed 5 while tapping or pushing the pins back into the receiver 100.

The materials of construction of the PFDB 2, or its constituent parts, can be any as known and suitable in the art, including but not limited to wood, metal, plastic or resin, or other suitable materials. The size and materials of construction of the PFDB 2 and its individual parts may vary, depending on several factors, such as the pistol(s) the unit is designed for, the materials of construction and manufacturing process used. To achieve the desired strength, durability and efficiency of the PFDB 2, the planning, design and manufacturing stage will determine the exact size of the PFDB 2 depending upon the material used.

The PFDB 2 can be produced in a number of different, or even slightly different, models. For example, the basic pistol bed 5 and configuration of bed wall 9, FIG. 1-2, of the PFDB 2 can be modified to accommodate different designs, sizes and shapes of pistols, of various manufacturers. With the correct model PFDB 2, the user can perform the recommended maintenance for any pistol that requires the removal of components for disassembly and reassembly.

Additionally, and turning generally to FIGS. 6-12A, other embodiments that use a multi-piece, rather than a single-piece construction, are disclosed.

Figure 6:
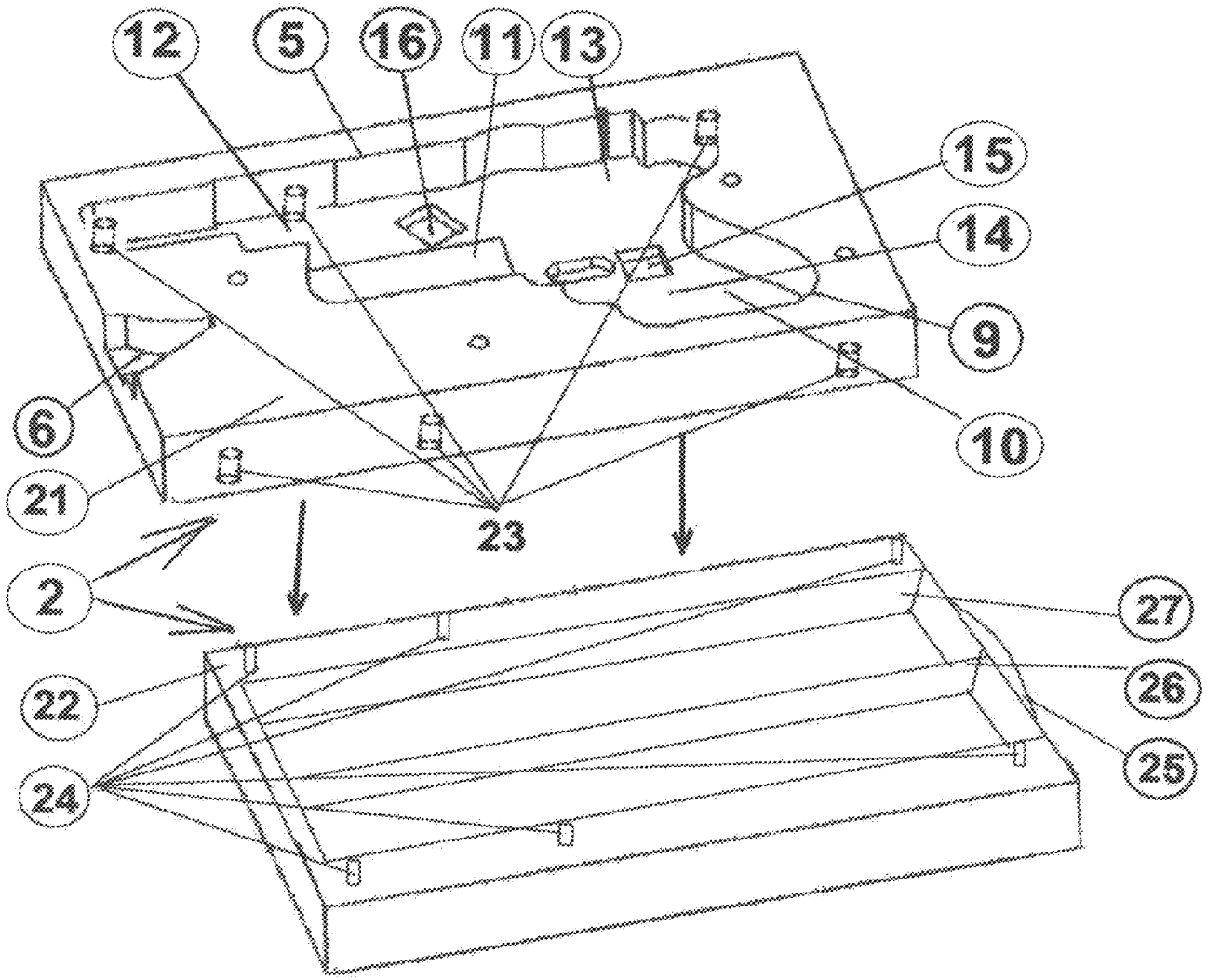
FIG. 6 is a schematic perspective view of another embodiment of the invention.

Turning to FIG. 6, a two-piece embodiment of a pistol frame disassembly bed 2 is shown. This pistol frame disassembly bed 2 is comprised overall of a top unit 21 and a base unit 22. The top unit 21 sits atop the base unit and has the bed wall 9 bed depression 10 and accompanying components and apertures from previous embodiments.

The base unit 22 has a drawer 27 that is typically (though it need not be) removeable. The drawer 27, as is the case of the drawer in previous embodiments, can be of any suitable and known configuration for storing components and providing ease of exposure or removal of the drawer from the base unit 22. The drawer in this embodiment has a drawer pull 25 and a drawer divider 26. The divider 26 maintains separation of firearm components, such as pins, as they fall through apertures such as pass-through Apertures 15 and 16.

The top unit 21 sits atop the base unit 22 and the top unit 21 and base unit 22 have a reversible attachment mechanism 23-24 capable of being fitted together and detached when desired. The respective units can be fitted together by any suitable method in the art such as, e.g., latches and catches, hooks and hoops, or tongues and grooves. In this embodiment, the attachment mechanism 23-24 is a set of apertures 23 and posts 24. In this embodiment, the top unit 21 has a set of post apertures 23 shown in dashed lines, and the base unit 22 has a set of corresponding posts 24. The posts are placed within the respective apertures to secure the top unit 21 and base unit. The placement of the posts 24 and apertures 23 can be reversed or alternated. The top unit 21 and base unit 22 can be simply pulled apart to detach when desired. The posts 24 can be separately attached to a unit during construction or can be part of a single-piece construction of a unit.

The top unit 21 and base unit, as in previous embodiments, can be of any suitable size, shape, and depth depending on the type of firearm it will be used for. In this embodiment, the top unit 21 is about one-inch in depth and the base unit 22 is about 1.5 inches in depth. The top unit 21, base unit 22 and drawer 27 can be comprised of any suitable material or combination of materials in the art such as, but not limited to, a plastic or resin, metal, glass, wood, or rubberized material.

Figure 7:
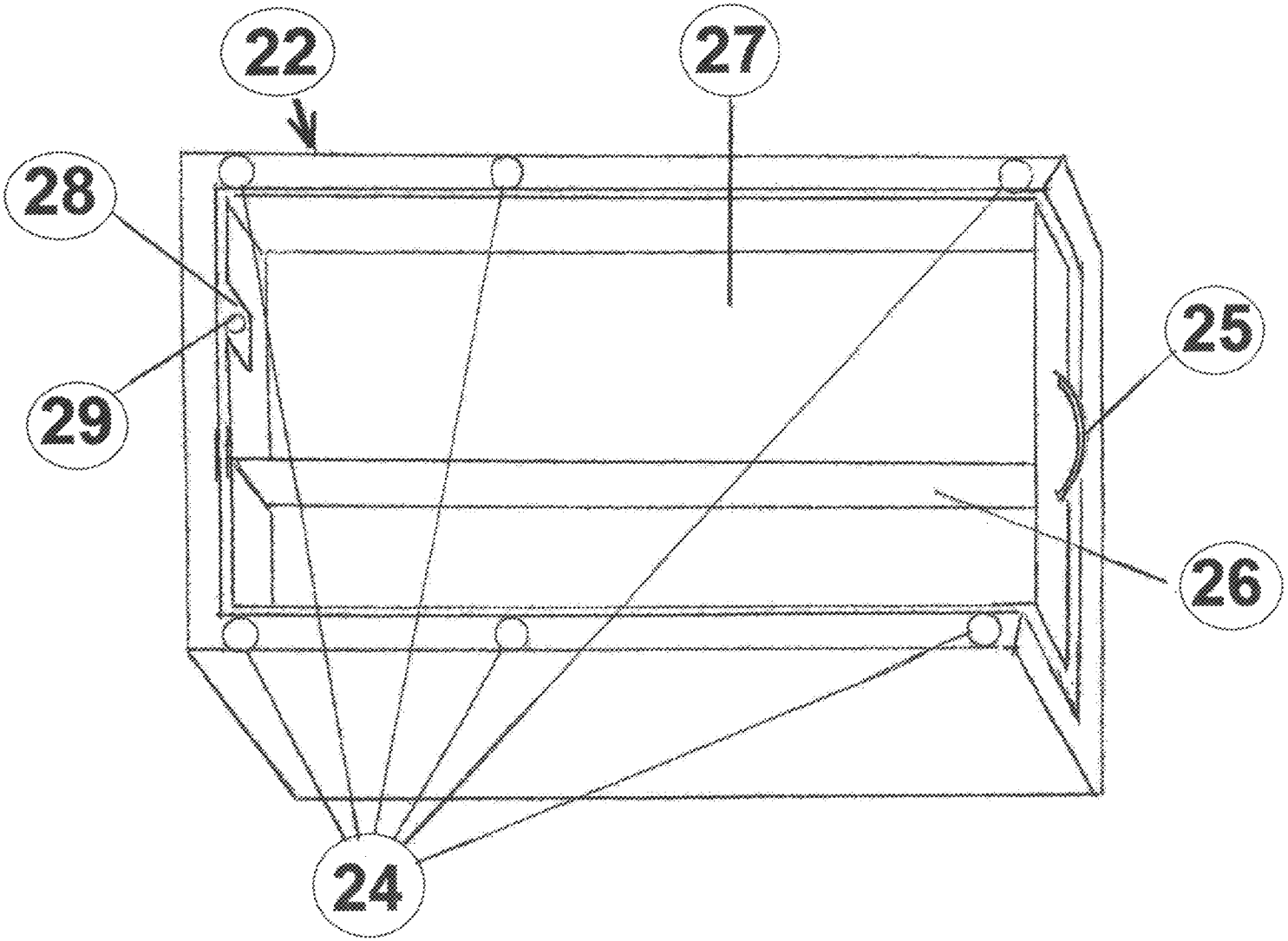
FIG. 7 is a schematic perspective bottom view of the embodiment of FIG. 6.

Turning to FIG. 7, the base unit 22 is shown in further detail. There is further a drawer recessed aperture or gap 28 and a base unit recessed cup holder 29. These work together to provide a convenient place for holding the firing pin cup. These can avoid much inconvenience, as firing pin cups are small parts that often "fly off" during maintenance and can be very difficult to find if dropped or lost.

Figure 8:
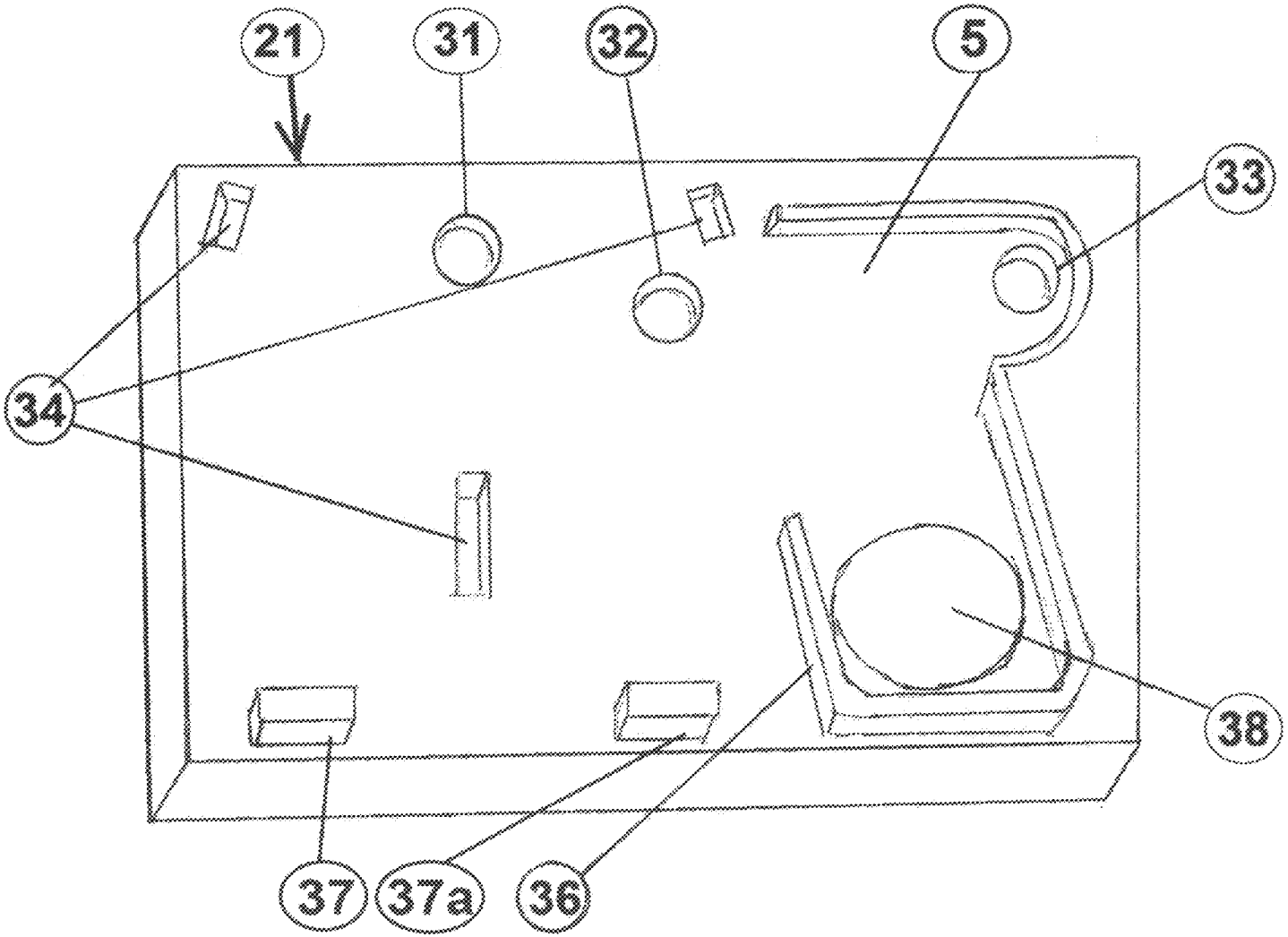
FIG. 8 is a schematic perspective top view of a further embodiment of the invention.

Turning to FIG. 8, a number of alternative types of top units can be used with the base unit 22 to support a variety of firearms and purposes. The multi-piece design of this and other embodiments offers several advantages. A number of different top units can be interchangeable with the base unit 22, so that a single base unit can be used with a number of different top units. Providing a single base unit that can accommodate a number of top units can provide a pistol frame disassembly bed 2 for a number of firearms without the need for an entire separate unit for each type of firearm. This ability to interchange different top units can reduce the cost of manufacturing the PFDB 2 per firearm and reduce inventory space requirements at all levels of the distribution process.

In this embodiment, a top unit 21 capable of accommodating a Y-Block is provided. This top unit 21 has pass-through apertures 31, 32, 33 at suitable locations and a supportive pad 38 to cushion a firearm. A set of Y-Block receptacle slots 34 is provided for attaching a Y-Block (to be discussed). Also, one or more frame guides (in this embodiment, a single frame guide) 36 is provided to help seat a firearm, or part of a firearm, in the top unit 21.

To further maximize utility, a single PFDB 2 top unit can be designed to fit several different models of a pistol, provided the models are similar in size and part placement. This is more likely the case (though not necessarily always) with pistols of the same or similar lines from a common manufacturer. For example, multiple Glock™ pistols can be serviced with a single PFDB 2 top unit design because a number of Glocks are of similar size and shape.

Figure 8A:
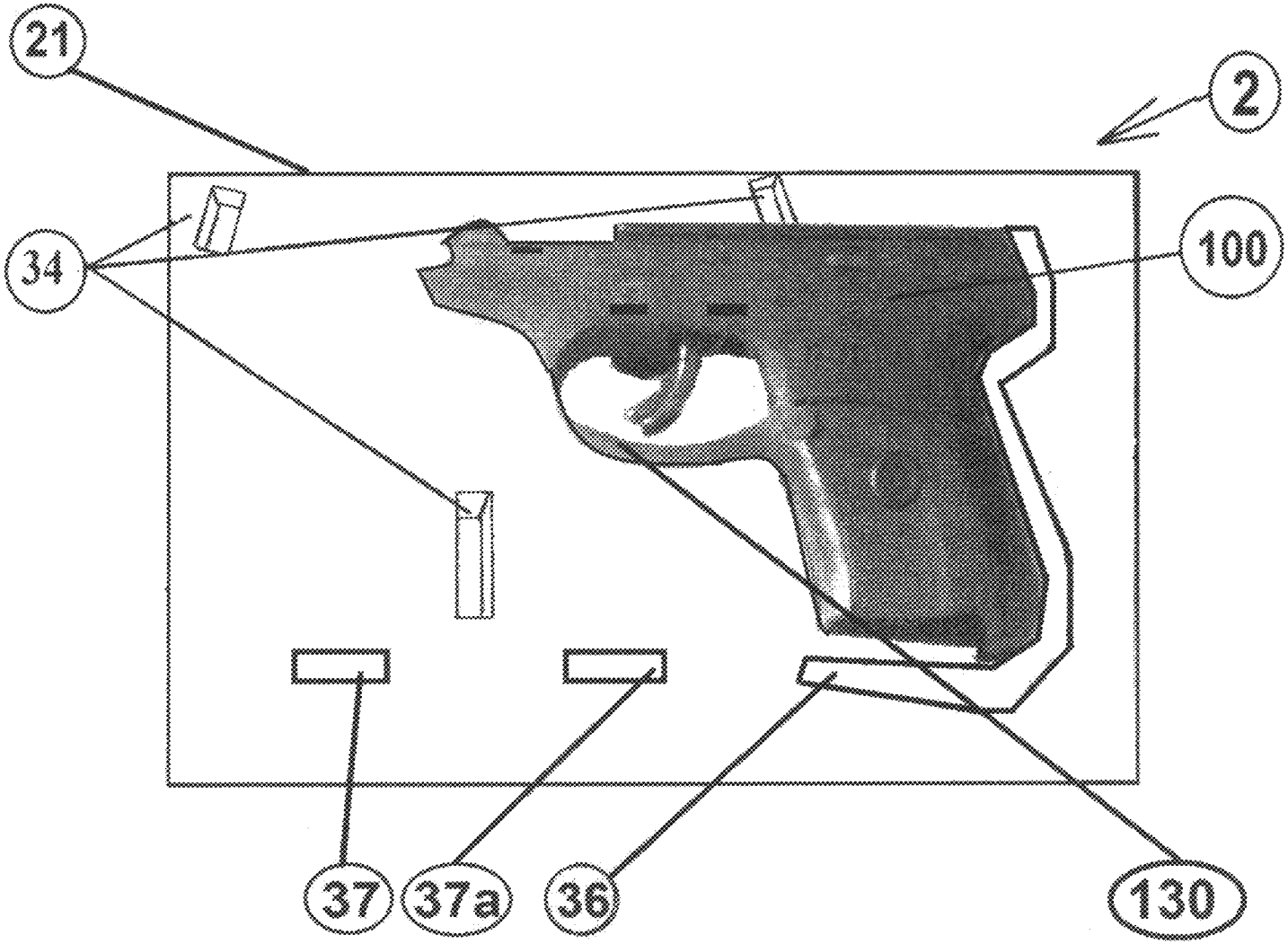
FIG. 8A is a schematic top plan view of the embodiment of FIG. 8 showing the invention in use with a portion of a firearm.

Turning to FIG. 8A, a top unit 21 holding a firearm, is shown. The bed 5 for this series has a raised frame guide set 36 that in this embodiment is about 0.375 inches high and 0.25 inches wide, and is designed to match the general shape of the pistol line. The size, configuration, and location of the bed 5, frame guide 36, and other components and apertures can herein be adjusted to the firearm the top unit 21 is designed for.

Another example of several pistols of the same line that can be serviced with a single PFDB 2 top unit design is the Ruger line known as the LC380, LC-9, LC9s and LC9SPRO hand guns. In the embodiments herein of FIGS. 8-12A, it is a PFDB 2 for this Ruger line, and a Ruger LC9, that is shown and featured.

Figure 9:
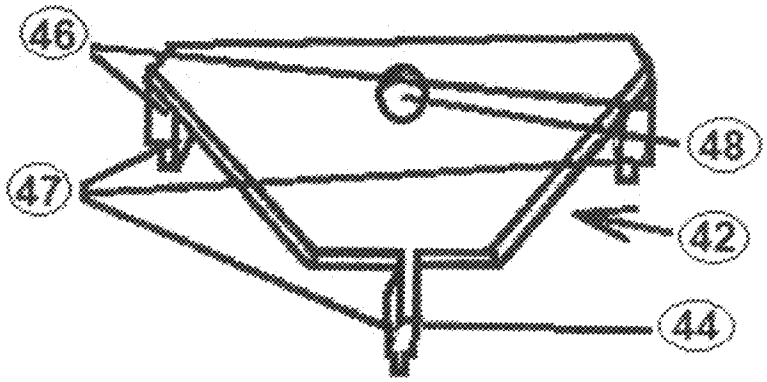
FIG. 9 is a schematic perspective view of a "Y-Block" that can be used with the embodiment of FIGS. 8-8A to create a further embodiment.
Figure 9A:
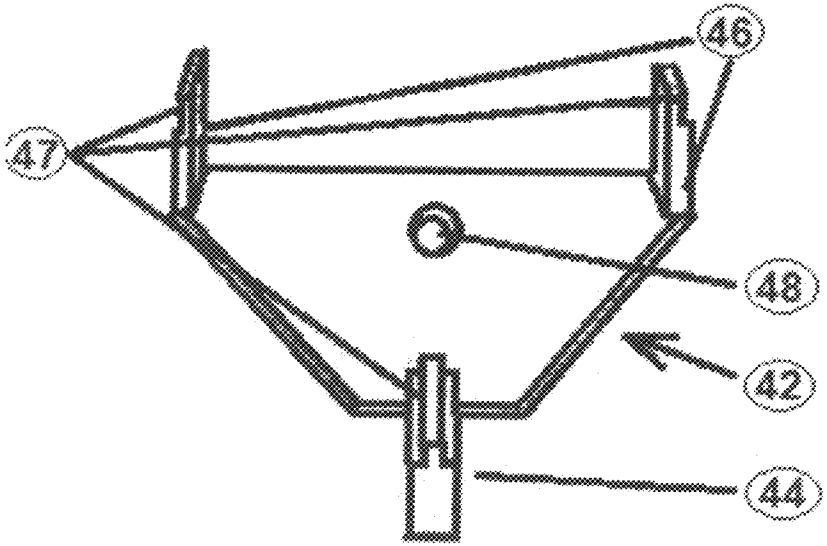
FIG. 9A is a schematic bottom perspective view of the "Y-Block of FIG. 9.

Turning to FIGS. 9 and 9A, an additional component to assist with firearm maintenance, a Y-Block 42, is shown. FIG. 9 shows the Y-Block 42 from an upper perspective view and FIG. 9A shows the same Y-Block 42 from an opposing lower perspective view. The Y-Block 42 is comprised of at least one access aperture 48 to provide access to a specific portion of a secured firearm, and a set of supports 44, 46 that connect the Y-Block 42 to the top unit 21 configured to accept the Y-Block. The support set in this embodiment is comprised of at least one lower key 44\ and at least one upper key 46, which straddle the firearm. The number and placement of keys can be altered, depending upon factors such as the size and shape of the firearm. In this embodiment, there is one lower key 44 and a pair of upper keys 46, in a generally Y-shaped configuration.

The Y-Block 42 can be used to assist in the maintenance process for some models as necessary. The Y-Block, as with other components herein, can be of any suitable size and configuration, and constructed of any material or suitable combination of materials, within the art. The Y-Block 42 can be made, for example, of wood, a metal, resin or other plastic, rubber or rubberized materials or combination of these. In this embodiment, the Y-block is made of a plastic, and has an overall approximate size of 6.5×4×1.5 inches.

Figure 10:
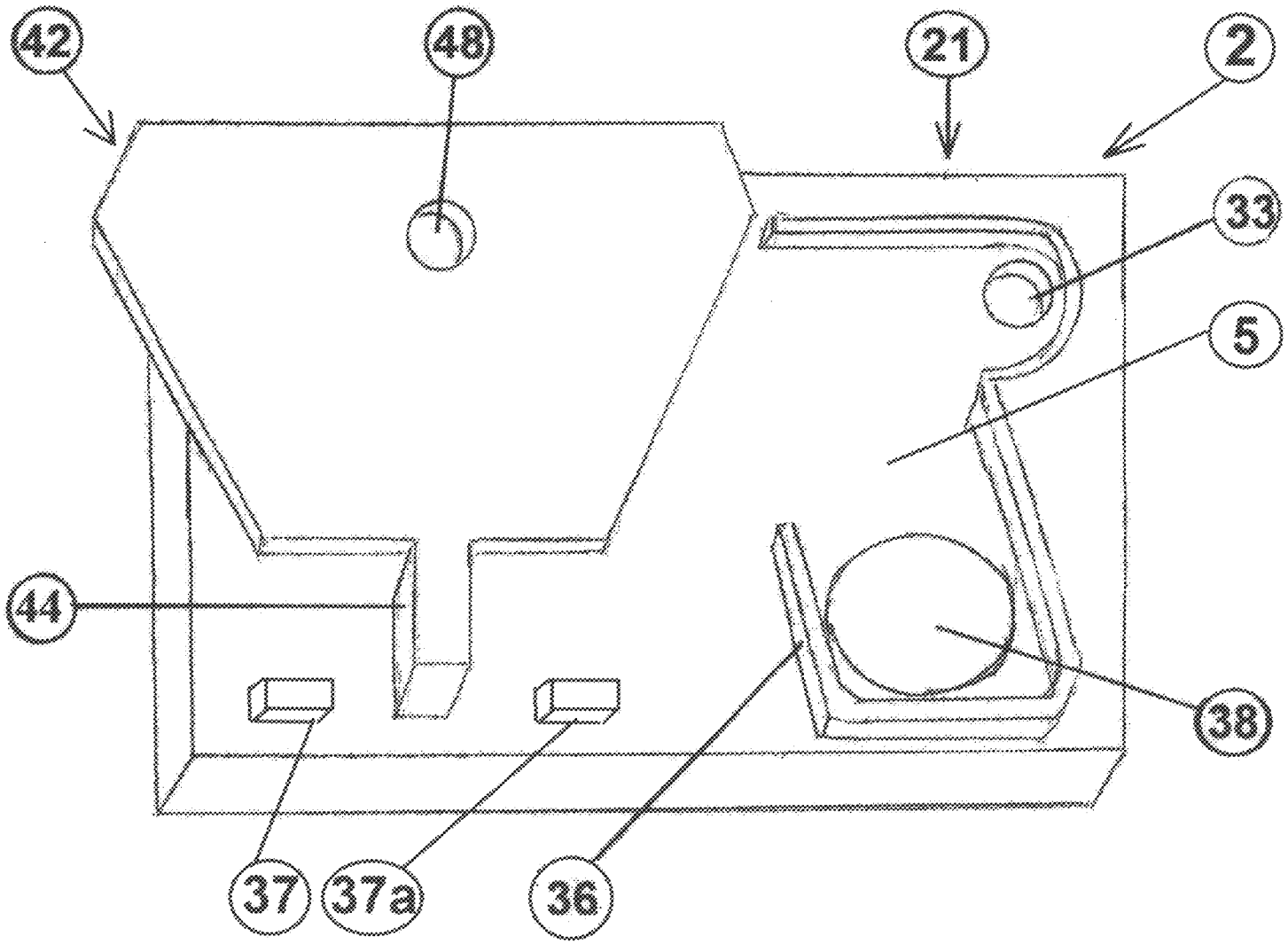
FIG. 10 is a schematic top perspective view combining the components of FIGS. 8 and 9-9A.

Turning to FIG. 10, the Y-Block 42 is shown secured onto the top unit 21. There are also accompanying apparatus for securing the keys 44, 46 of the Y-block 42 to the top unit 21. The securing apparatus can be of any suitable type in the art capable of reversibly securing the Y-Block 42 to the top unit 21, including, but not limited to, a set of notches and slots, pegs and pre-drilled holes, or hooks and loops. In this embodiment, a set of key notches 47 is provided at the bottom of the respective upper and lower keys 44, 46 and, returning briefly to turning to FIG. 8, a corresponding set of Y-Block receptacle slots 34.

Figure 11:
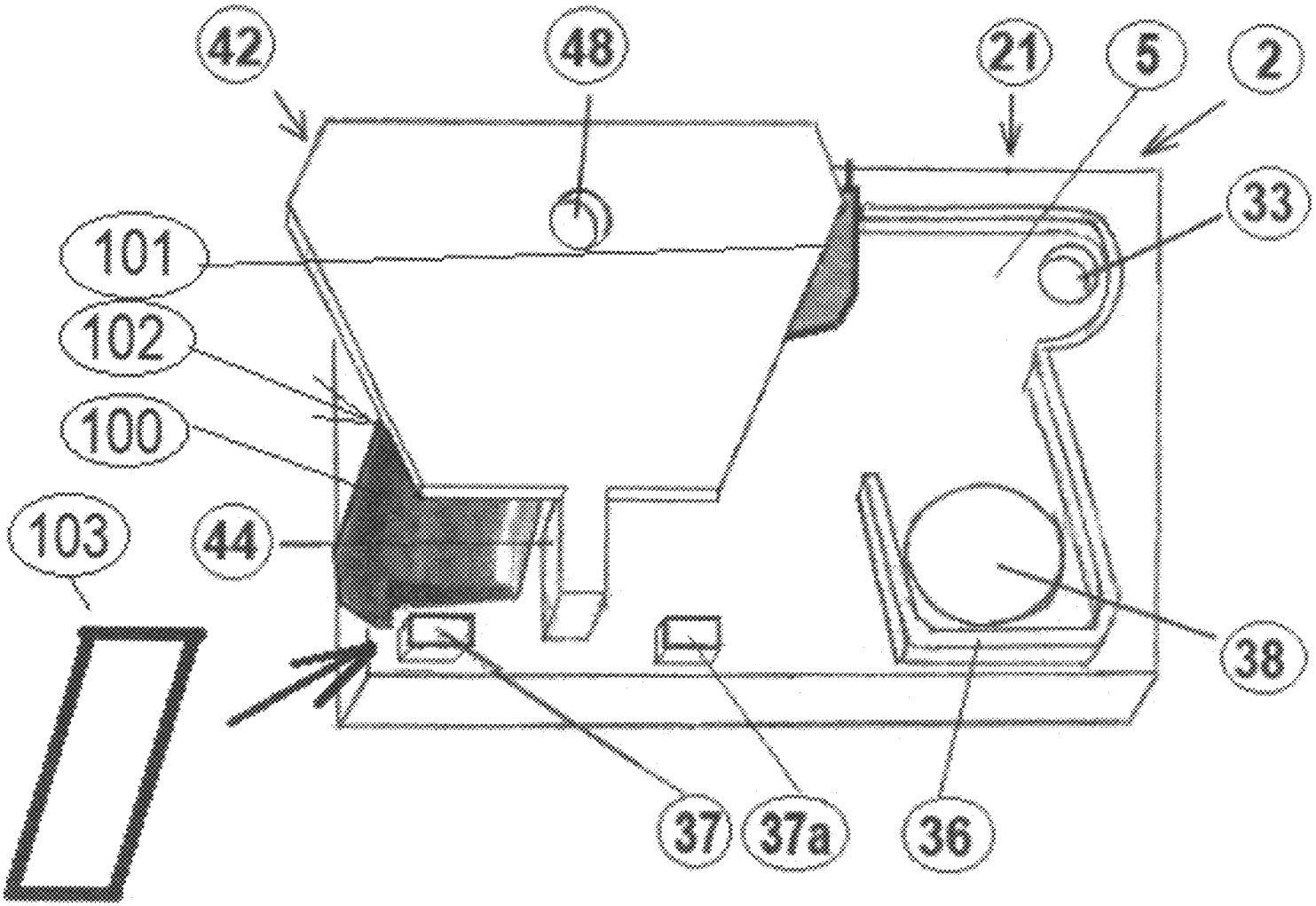
FIG. 11 is a schematic top perspective view of the embodiment of FIG. 10 showing the invention in use with a firearm.

Turning to FIG. 11 and referring also to FIG. 8A, a firearm 102, in this embodiment a Ruger LC-9, is placed in a first position on the top unit 21 to remove the slide portion 101. The Y-block 42 is secured to the top unit 21 such that the firearm 102 is secured between the Y-block 42 the top unit 21. Generally, the firearm 102 is placed in a first position on the top unit 21, in this embodiment a forward position, to remove the slide 101, and in a second position, to remove the trigger assembly for cleaning, maintenance, and the like.

The Y block 42 and top unit 21 have a number of components to provide extra safety during firearm maintenance procedures. Firearm magazine blocking posts 37, 37*a* are provided atop the top unit 21. The magazine 103 will protrude slightly from the bottom of the grip of the firearm 102 The magazine blocking posts 37, 37*a* are positioned such that they will meet the firearm 102 at the bottom of its grip when the firearm 102 is laid on the top unit 21, but such that the magazine 103, if it is left in the firearm 102 by mistake, will collide with one of the magazine blocking posts 37, 37*a*. If this occurs, the firearm 102 will be blocked from laying down in the top unit 21, preventing any procedures to the firearm 102 unless the magazine 103 is removed. In this configuration, the firearm 102 rests snugly against a magazine blocking post 37 firearm 102, and the user can be confident the magazine 103 is not present.

In this embodiment, the slide 101 can be separated from the receiver 100 by removing a first post or pin. To remove the slide, a user, in this embodiment, flips a gate on one side of the firearm 102, turns the firearm over, and places the firearm 102 on the top unit 21 in a first position. The Y-block 42 is placed above the firearm, securing the firearm 102 to the top unit 21. A user can further secure the firearm 102 by holding the firearm 102 at the bottom.

As mentioned, the magazine blocking post 37 insures the magazine is not still in the firearm 102. The Y-block 42 provides a secondary safety feature. A secondary danger to a user is that if a shell is in the chamber, and the user accidentally pulls at the trigger of the firearm 102, the firearm 102 could unintentionally discharge. The shape of the Y-block 42 provides a barrier to the trigger area, helping a user to prevent them from accidentally placing a finger or part of a finger into the trigger area.

An access aperture 48 is provided in the Y-block. In this embodiment, the Ruger pistol has the gate to the post or pin, but no indication is provided as to the location of the post or pin on the other side of the firearm 102. The access aperture 48 helps with this issue. The access aperture 48 is pre-positioned in the Y-block 42 such that it will be directly over the locking block pin 120 after the Y-Block 42 is secured to the top unit 21. A user can then place a punch or other suitable tool through the access aperture 48 and use it to discharge the locking block pin 120 downward and through pass-through aperture #3 31. With the locking pin safely secured in the drawer 7, the Y-Block 42 is removed, and the slide 101 can be easily and safely separated from the receiver 100 by applying a small amount of pressure to move the slide an equal but opposite distance from the receiver 100.

Returning to FIG. 8A, with the slide 101 removed, the firearm receiver 100 is placed on the top unit 21 within the frame guide 36. From this secure position, the trigger assembly 130 of the firearm can be removed by removing additional pins into pre-set apertures. In this embodiment, the trigger housing pin 122 and trigger pin 124 are removed.

Figure 12:
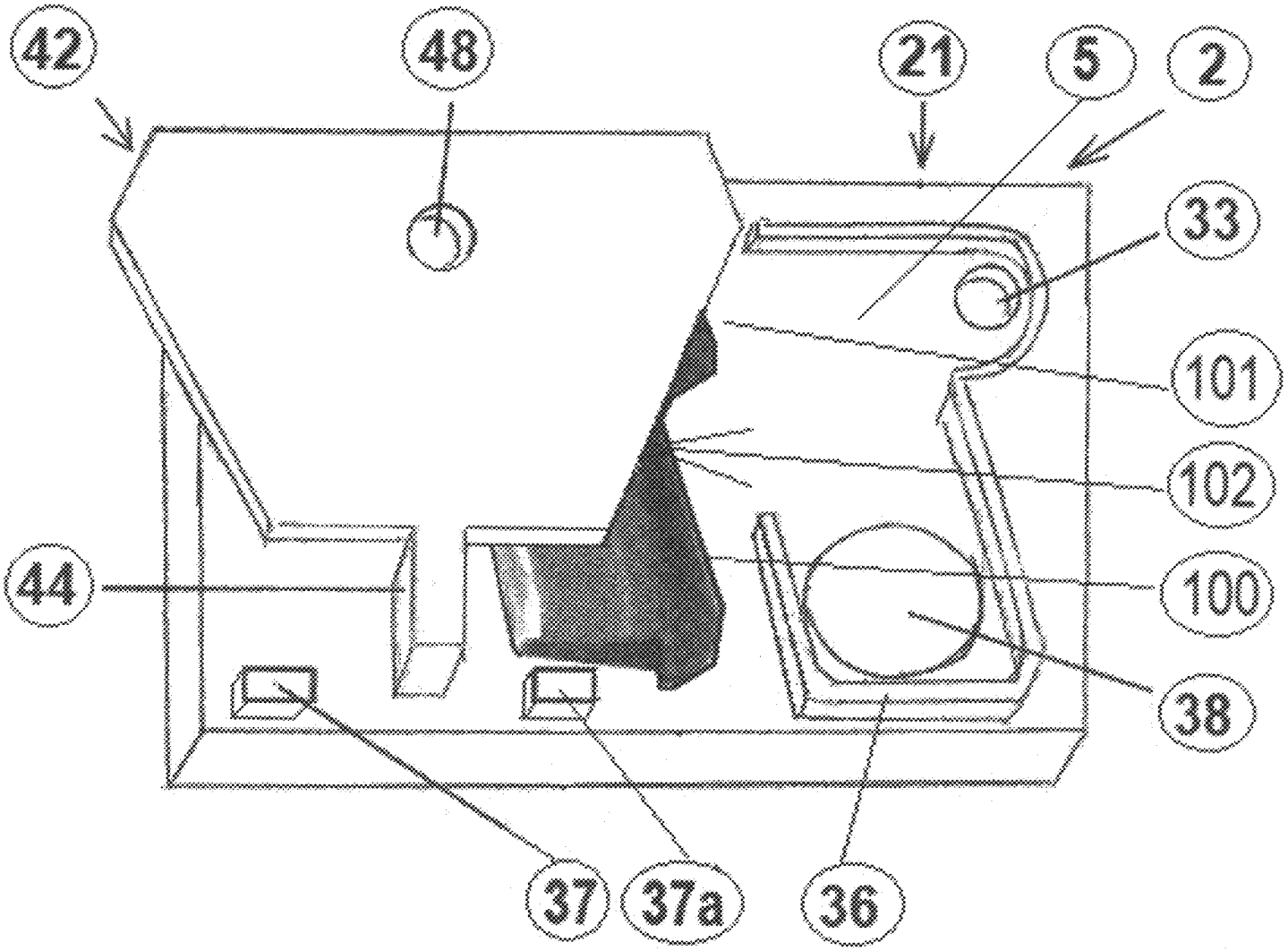
FIG. 12 is a schematic top perspective view of the embodiment of FIG. 11 in a different configuration of use.

Turning to FIG. 12 and referring also to FIG. 8A, when the maintenance, cleaning or other procedure is completed and the user wants to reassemble the firearm 102, to place the locking block pin 120 back and rejoin the slide 101 and receiver 100, the components can be secured on the top unit 21 in a second position, against a second magazine blocking post 37*a* to protect the user. The Y-block 42 is again secured to the top unit 21 and the access aperture 48 is used again to place the locking block pin 120 back into place.

Figure 12A:
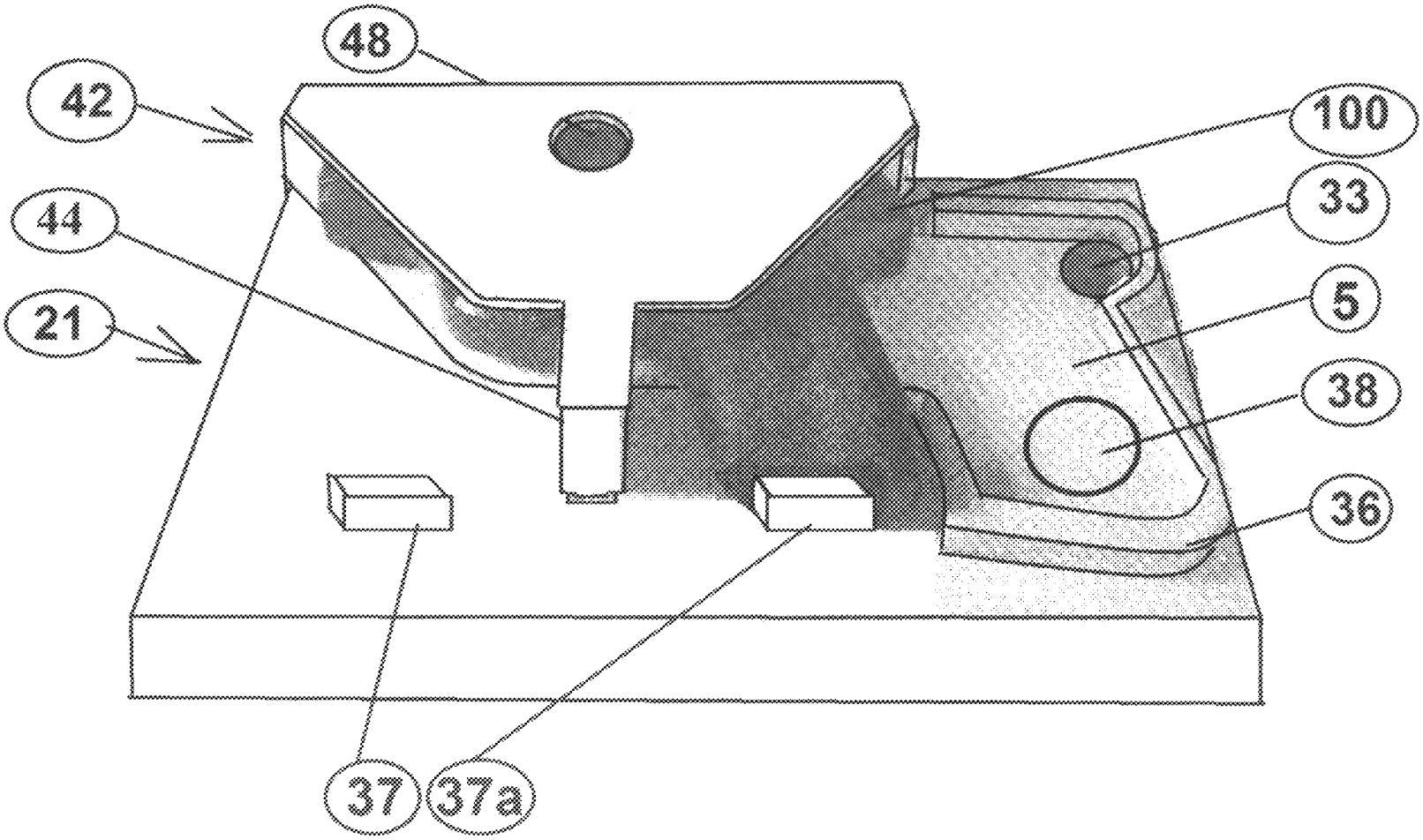
FIG. 12A is a perspective view of the embodiment of FIG. 12 viewed from a differing angle.

Turning briefly to FIG. 12A, the PFDB 2, with the firearm 102 fully assembled, is shown.

Figure 13:
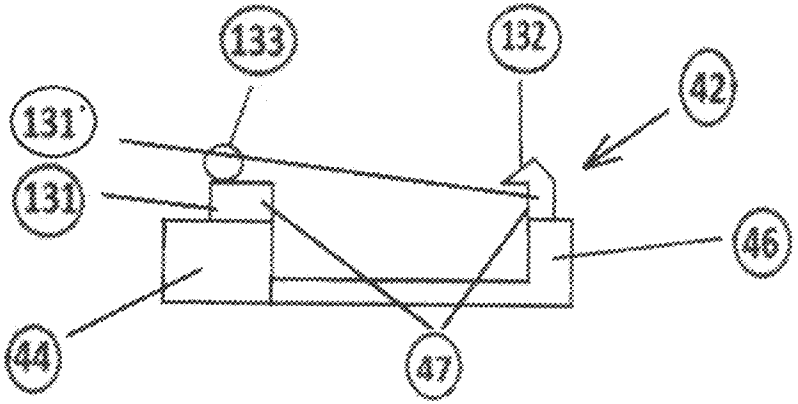
FIG. 13 is a schematic side view of another embodiment of the "Y-Block" with alternative safety securing apparatus.
Figure 13A:
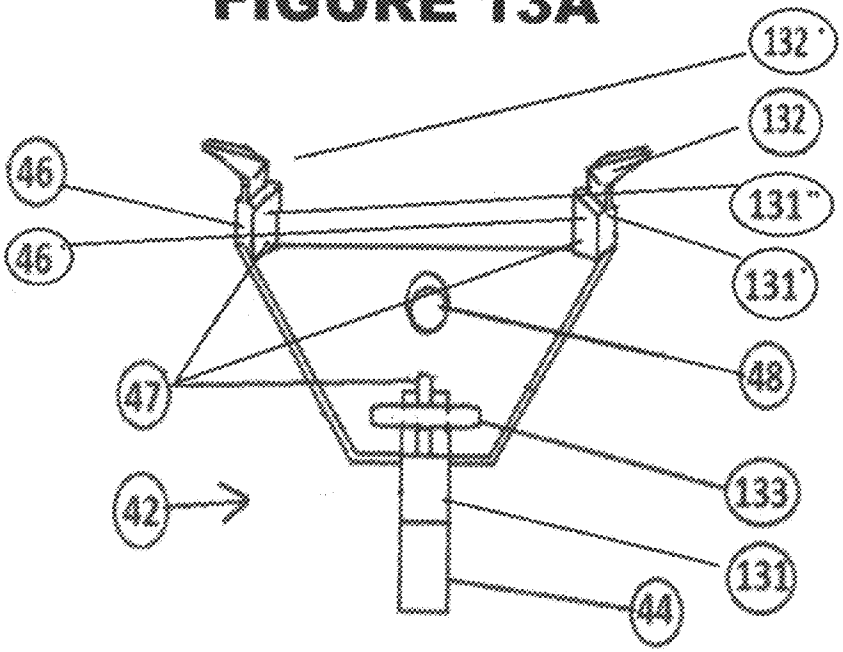
FIG. 13A is a schematic bottom perspective view of the "Y-Block embodiment of FIG. 13.
Figure 14:
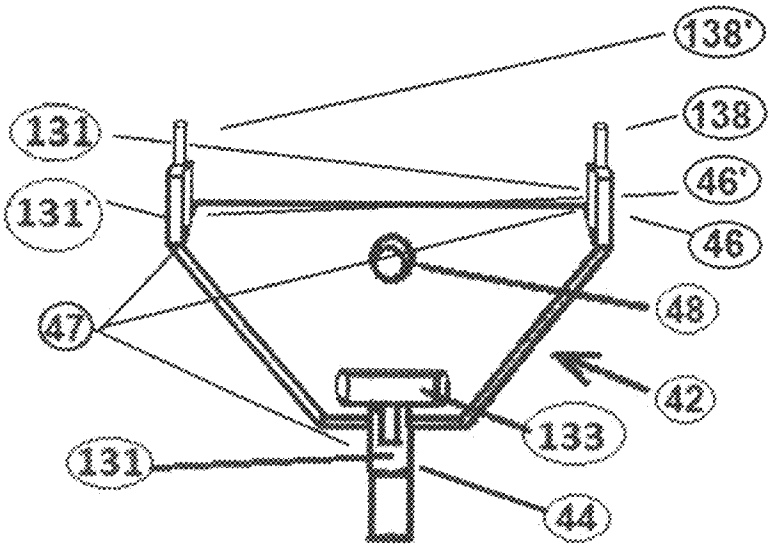
FIG. 14 is a schematic bottom perspective view of a "Y-Block embodiment similar to FIG. 13, but in an altered configuration.
Figure 15:
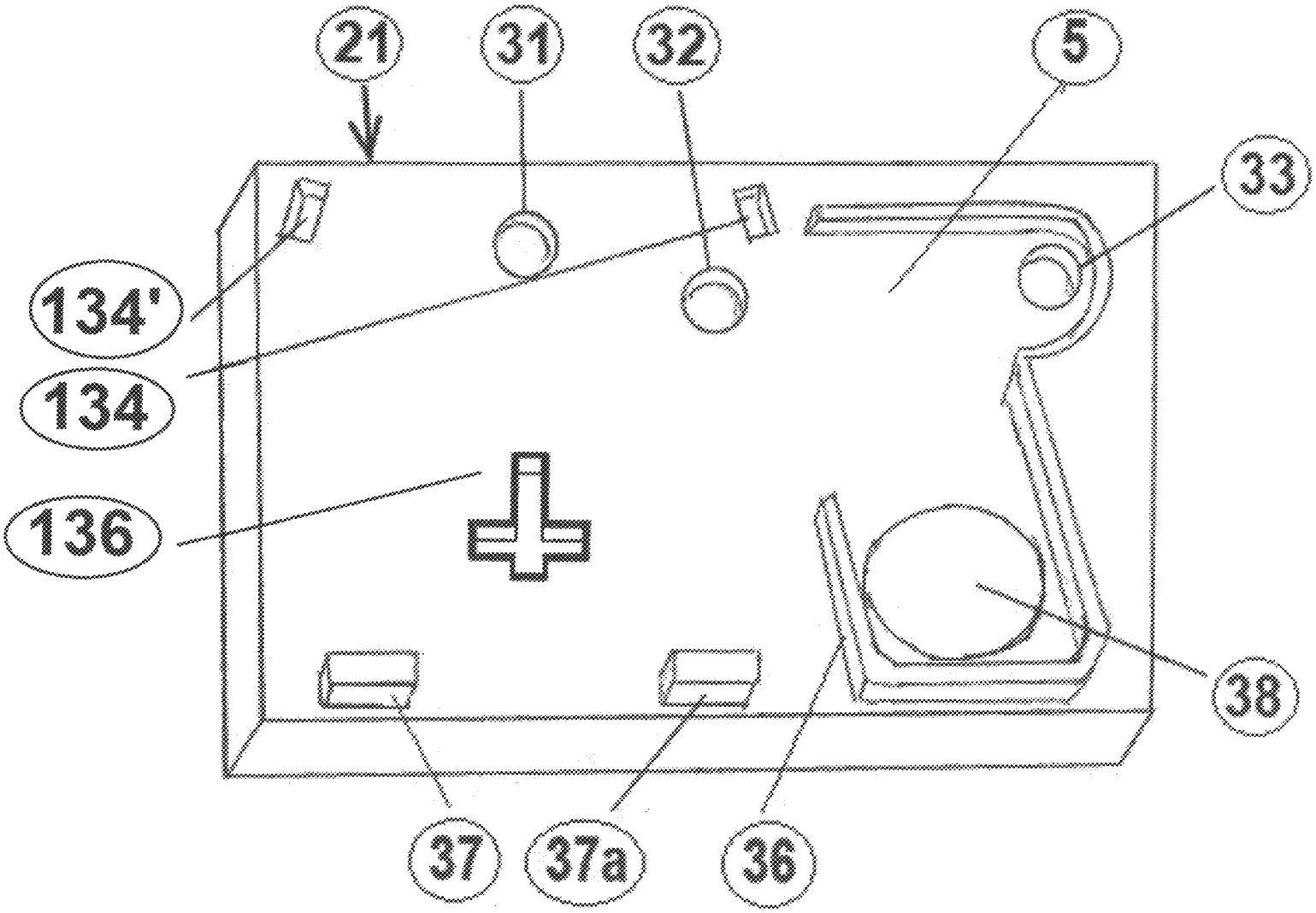
FIG. 15 is a schematic perspective top view of a top unit for the embodiment of FIG. 13.

Turning to FIGS. 13-15, another set of embodiments of the invention are shown. An alternate set of apparatus for securing the Y-block 42 to the top unit 21 that provides specific advantages, so that a firearm can be worked upon without slippage, are discussed and shown.

Figure 13B:
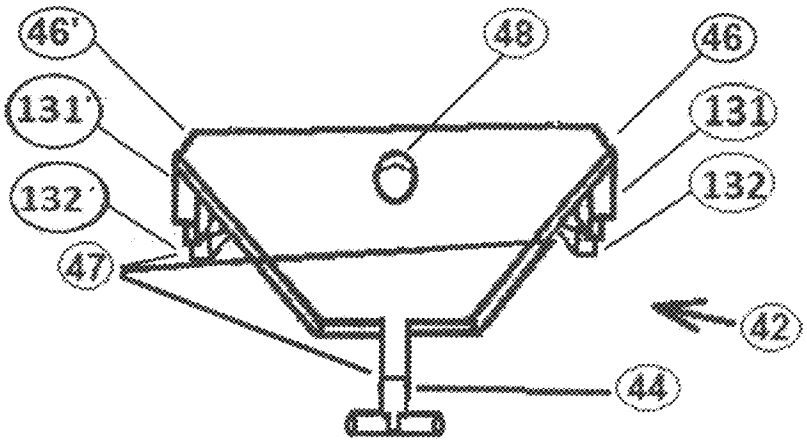
FIG. 13B is a schematic upper perspective view of the "Y-Block" embodiment of FIG. 13.

Turning first to FIG. 13-FIG. 13B, A Y-Block configuration is shown from a number of perspectives. The key notch set 47 in these embodiments is generally comprised of a set of partial key notches 131, 131', 131" attached, respectively, to a lower key placement rod 133 and upper key placement hooks 132, 132'.

The placement rod 133 is rounded, attached to the end of its respective partial key notch 131, and is generally perpendicular to the partial key notch 131. The upper key placement hooks 132, 132' have a protruding triangular, partially triangular, or hook-shaped horizontally extending protrusion in orientation to the Y-block 42". In this embodiment, the upper key placement hooks are each in the shape of a pair of combined triangles, one of them protruding from each partial key notch 131' 131". The placement rod 133 and key placement hooks 132, 132' are also generally perpendicular in relation to each other.

Turning briefly to FIG. 15, an alternative top unit 21 with securing apparatus for the Y-block embodiments of FIG. 13, 13B is disclosed. The top unit 21 is comprised of at least one, and here a pair of, hook receptacle slots 136, 136'. The top unit 21 is further comprised of a placement rod receptacle slot 134. The placement rod receptacle slot 134 is generally cross-shaped, to accommodate the partial key notch 131 and placement rod 133, which are perpendicular to each other.

Turning to FIGS. 13-13B, FIG. 15, and loosely to FIGS. 11-12A, when a user wants to work on a firearm, the user can place the firearm 102 on the top unit 21, as with other embodiments. The magazine blocking posts 37, 37A are provided, as in previous embodiments, to help the user insure that the magazine 103 has been removed from the firearm 102.

The lower key placement rod 133 can be placed at the placement rod receptacle slot 134 to guide the Y-block 42 onto the top unit 21. By moving the Y-Block in a downward and forward manner in the direction of the lower key notches 131', 131", the placement hooks 132, 132' slide downward and into the placement hook receptacle slots 136, 136'. Similarly, the lower key placement rod 133 is placed into the placement rod receptacle slot 134 with the same downward and forward motion to the Y-block 42. While the Y-Block is being slid into its operational position, the upper key notches 131' 131" allow the upper key placement hooks 132, 132', which protrude sufficiently from the placement hook receptacle slots 136, 136' so that they can lay inside the track of the placement hook receptacle slots 136, 136' when the Y-Block is slid into place, to slide under the surface of the top unit 21.

In this way, the protruding portion of the upper key placement hooks 132, 132' are embedded under the surface of the top unit 21. Further, the placement rod 133 is braced against a wall of the placement rod receptacle slot 134, the cross length of the placement rod 133 providing additional stability. In this manner, the key placement hooks 132, 132' and placement rod 133 work together to provide extra securement of the Y-block 42 to the top unit 21 when needed. This arrangement helps prevent the Y-Block 42 from coming loose or disengaging when in use, as long as a user uses the product according to directions or does not intentionally disregard the system.

Turning to FIG. 14, the key notch set 47 can be secured by other suitable apparatus, such as by providing other means onto the partial keys 131, 131', 131". For example, provided here on the Y-Block are placement pegs 138, 138' protruding from the upper partial key notches 131', 131". The placement pegs 138, 138' can be slid directly and securely into fitted slots as the Y-block 32 is fitted to the top unit 21. Along with the placement rod 133, these placement pegs 138, 138' provide alternate apparatus to secure the Y-block 42.

Disclosed herein is a device for assisting with the disassembly and reassembly of pistol components and for maintenance or upgrades such as the installation of improved slide locks or a trigger connector of a different pressure rating. Accordingly, a device and method of use is provided to users resulting in a steady platform with which to disassemble and reassemble pistols when necessary, which makes the pistol stable, safe, and prevents disastrous loss of parts and or damage to the pistol.

It is to be understood that while certain forms of the present invention have been illustrated and described herein, the expression of these individual embodiments is for illustrative purposes and should not be seen as a limitation upon the scope of the invention. It is to be further understood that the invention is not to be limited to the specific forms or arrangements of parts described and shown.

The invention claimed is:

1. A firearm disassembly bed system comprised of:

a top unit and a base unit, wherein the top unit is further comprised of a bed having a bed depression configured to hold a firearm frame within the bed depression, and wherein the bed depression is a three-dimensional depression incorporated at the top surface of the firearm frame disassembly bed and wherein the bed depression is configured generally in the shape of a portion of at least one firearm component, so as to accommodate the at least one firearm component, and wherein the top unit is further comprised of at least one aperture located within the firearm bed depression, and wherein the base unit is further comprised of a receptacle portion capable of receiving at least one firearm component through the at least one aperture, an apparatus for attaching the top unit and base unit to each other in a reversible manner, and a Y-block comprised of at least one access aperture capable of providing access to a specific portion of a secured firearm, a set of supports connecting the Y-Block to the top unit, and a securing apparatus for reversibly securing the supports to the top unit and wherein the set of supports is further comprised of one lower key and a pair of upper keys, and wherein the lower key is below the trigger assembly of the firearm and the pair of upper keys is in proximity to the barrel of the firearm.

2. The firearm disassembly bed system of claim 1, wherein the securing apparatus is further comprised of a respective set of slots or apertures in the top unit for accommodating the set of keys.

3. The firearm disassembly bed system of claim 1, wherein the firearm bed depression and the at least one aperture in the firearm bed depression are configured for service of one or more of the Ruger™ LC380, LC-9, or LC9SPRO lines of hand guns.

4. The firearm disassembly bed system of claim 1, wherein the Y-Block is composed of wood, a metal, resin or other plastic, rubber or rubberized materials or a combination thereof.

5. The firearm disassembly bed system of claim 1, wherein the Y-Block is composed of a plastic, and has an overall size of 6.5"L×4"W×1.5"H inches.

6. The firearm disassembly bed system of claim 1, wherein the apparatus for reversibly securing the supports to the top unit is comprised of a set of key notches and receptacle slots, pegs and pre-drilled holes, or hooks and loops.

7. The firearm disassembly bed system of claim 1, wherein the Y-Block is further comprised of at least one magazine blocking post atop the top unit, and wherein the at least one magazine blocking post is positioned such that the at least one magazine blocking post will meet the firearm at the bottom of the firearm grip when the firearm is placed on the top unit with the magazine removed, but the at least one magazine blocking post will collide with the magazine if the magazine is left in the firearm, such that the at least one magazine blocking post will block the firearm from laying down in the top unit.

8. The firearm disassembly bed system of claim 1, wherein the at least one access aperture of the Y-block is pre-positioned in the Y-block such that the aperture would, when a firearm is secured between the Y-Block and the top unit be directly over the locking block pin of the firearm.

9. The firearm disassembly bed system of claim 1, wherein the securing apparatus is comprised of a set of partial key notches, wherein the partial key notches are respectively attached to at least one lower key placement rod and at least one upper key placement hook.

10. The firearm disassembly bed system of claim 1, wherein the securing apparatus is comprised of a set of partial key notches, at least one lower key placement rod attached to a respective at least one partial key notch at the bottom of the partial key notch, and at least one upper key placement hook attached to a respective at least one partial key notch at the bottom of the partial key notch, such that each partial key notch is attached to either a lower key placement rod or an upper key placement hook.

11. The firearm disassembly bed system of claim 1, wherein the securing apparatus is comprised of a set of three partial key notches, a lower key placement rod attached to a respective partial key notch at the bottom of one of the partial key notches, and a pair of upper key placement hooks attached to a respective pair of partial key notches at the bottom of the partial key notches, wherein the key placement rod is oriented generally perpendicular to the partial key notch the key placement rod is attached to, a placement lower key placement rod receptacle slot located within the top unit and configured to accommodate the lower key placement rod and a pair of hook receptacle slots located within the top unit and capable of accommodating the respective pair of upper key placement hooks.

12. The firearm disassembly bed system of claim 11, wherein the placement rod is generally in a rounded configuration.

13. The firearm disassembly bed system of claim 11, wherein the upper key placement hooks have a protruding triangular, partially triangular, or hook-shaped horizontally extending protrusion.

14. The firearm disassembly bed system of claim 13, wherein the upper key placement hooks are each in the general shape of a pair of combined triangles, and wherein one of the triangular portions protrudes from each respective partial key notch.

15. The firearm disassembly bed system of claim 1, wherein the securing apparatus is comprised of a set of partial key notches and either:

a set of Y-Block placement pegs attached to and protruding from the partial key notches and a set of corresponding fitted slots within the top unit or, a set of top unit placement pegs attached to and protruding from the top unit, and a set of corresponding fitted slots within each of the upper keys.

16. The firearm disassembly bed system of claim 1, wherein the bed depression is generally comprised of a forward frame area, a rear frame area, and a pistol grip receiving area.

17. The firearm disassembly bed system of claim 1, wherein the at least one aperture in the top unit is 2-4 apertures.

18. The firearm disassembly bed system of claim 1, wherein the top unit is further comprised of at least one raised frame guide bordering or outside the bed depression area.

19. A firearm disassembly bed comprised of:

a bed having a bed depression configured to hold a firearm frame within the bed depression, wherein the bed depression is a three-dimensional depression incorporated at the top surface of the firearm disassembly bed and wherein the bed depression is configured generally in the shape of a portion at least one firearm component, so as to accommodate the at least one firearm component, at least one aperture located within the firearm bed depression, and a receptacle portion located beneath the bed depression capable of receiving at least one firearm component through the aperture, and a Y-block, wherein the Y-Block is comprised of:

at least one access aperture capable of providing access to a specific portion of a secured firearm, and a set of supports connecting the Y-Block to the bed such that the Y-block and bed are capable of securing a firearm between the Y-block and bed, and apparatus for securing the supports to the bed and wherein the set of supports is further comprised of one lower key and a pair of upper keys, and wherein the lower key is below the trigger assembly of the firearm and the pair of upper keys is in proximity to the barrel of the firearm.

* * * * *